US009623662B2

(12) United States Patent
Seras Franzoso et al.

(10) Patent No.: US 9,623,662 B2
(45) Date of Patent: Apr. 18, 2017

(54) SUPPLY FLUID FROM A FLUID CHAMBER TO A POROUS WIPE MATERIAL TO WIPE A PRINTHEAD

(71) Applicant: Hewlett-Packard Development Company, L.P., Houston, TX (US)

(72) Inventors: Mauricio Seras Franzoso, Sant Cugat del Valles (ES); Marta Coma Vives, Sant Cugat del Valles (ES); Antonio Gracia Verdugo, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/892,463

(22) PCT Filed: May 28, 2013

(86) PCT No.: PCT/US2013/042906
§ 371 (c)(1),
(2) Date: Nov. 19, 2015

(87) PCT Pub. No.: WO2014/193343
PCT Pub. Date: Dec. 4, 2014

(65) Prior Publication Data
US 2016/0096371 A1 Apr. 7, 2016

(51) Int. Cl.
*B41J 2/165* (2006.01)

(52) U.S. Cl.
CPC .... *B41J 2/16535* (2013.01); *B41J 2002/1655* (2013.01); *B41J 2002/16558* (2013.01)

(58) Field of Classification Search
CPC ..... B41J 2/16535
See application file for complete search history.

(56) References Cited

U.S. PATENT DOCUMENTS 5,905,514 A * 5/1999 Rhoads ..... B41J 2/16552 347/31
6,250,736 B1 * 6/2001 Wojcik ..... B41J 2/16544 347/28

(Continued)

FOREIGN PATENT DOCUMENTS

JP 2000-062242 2/2000
JP 2004001307 1/2004

OTHER PUBLICATIONS

DIGICAMHELP, "Inkjet printer maintenance", download date Oct. 14, 2015, 4 pages. http://www.digicamhelp.com/processing-photos/printing/printer-maintenance/.

(Continued)

*Primary Examiner* — Bradley Thies
(74) *Attorney, Agent, or Firm* — HP Inc Patent Development

(57) ABSTRACT

A cleaning module includes an actuator device, a fluid chamber, and a wiper member. The actuator device may enter an activation state based on a movement of at least a portion of the actuator device in response to an engagement with the printhead. The fluid chamber may store and supply fluid to the porous wipe material in response to the activation state of the actuator device. The wiper member may apply pressure to a porous wipe material including the fluid therein to wipe the printhead.

15 Claims, 7 Drawing Sheets

(56) References Cited

U.S. PATENT DOCUMENTS

| | | | | |
|---|---|---|---|---|
| 2003/0035671 | A1 | 2/2003 | Estabrooks | |
| 2006/0001710 | A1 | 1/2006 | Lee | |
| 2008/0006334 | A1 | 1/2008 | Davidson | |
| 2008/0238990 | A1 | 10/2008 | Inoue | |
| 2010/0091066 | A1* | 4/2010 | Lee | B41J 2/16535 347/28 |
| 2010/0092225 | A1 | 4/2010 | Lapstun | |
| 2011/0216127 | A1* | 9/2011 | Karppinen | B41J 2/165 347/33 |

OTHER PUBLICATIONS

International Search Report and Written Opinion dated Feb. 27, 2014 issued on PCT Patent Application No. PCT/US2013/042906 dated May 28, 2013, Korean Intellectual Property Office.

* cited by examiner

SUPPLY FLUID FROM A FLUID CHAMBER TO A POROUS WIPE MATERIAL TO WIPE A PRINTHEAD

CLAIM FOR PRIORITY

The present application is a national stage filing under 35 U.S.C. §371 of PCT application number PCT/US2013/042906, having an international filing date of May 28, 2013, the disclosure of which is hereby incorporated by reference in its entirety.

BACKGROUND

A cleaning module may clean a printhead of a printing system. The printhead may include a nozzle surface having nozzles to eject printing fluid there from. The cleaning module may include a wiper member to press a wipe material against the printhead to wipe the nozzle surface and remove fluid residue from the nozzle surface and/or nozzles.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A cleaning module may clean a printhead of a printing system. The printhead may include a nozzle surface having nozzles to eject printing fluid there from. The cleaning module may include a wiper member to press a wipe material against the printhead to wipe the nozzle surface and remove residue such as fluid residue, dust, unwanted fiber, and the like from the nozzle surface and/or nozzles. The wipe material, however, may be stored in a wet state to assist in the cleaning of the printhead. In the wet state, a size of the wipe material may be increased as compared to a dry state. Thus, a respective storage space of the cleaning module allocated for storing the wipe material may store a reduced amount of previously-wetted wipe material. Accordingly, a life of the cleaning module may be reduced due to the reduced amount of previously-wetted wipe material stored therein. Further, the fluid from the pre-wetted wipe material may evaporate from the wipe material and decrease its effectiveness at cleaning the printhead during a wiping operation.

In examples, a cleaning module includes a wiper member, an actuator device, a fluid chamber, and a second fluid channel disposed between the fluid chamber and the actuator device. The actuator device may enter an activation state based on a movement of at least a portion of the actuator device in response to an engagement with a printhead. The actuator device may include a first fluid channel therein. In the activation state, for example, fluid may be directed through the first fluid channel of the actuator device to a porous wipe material. The fluid chamber may store fluid and selectively supply the fluid through the second fluid channel and the first fluid channel to the porous wipe material in response to the activation state of the actuator device. The wiper member may apply pressure to the porous wipe material including the fluid therein to wipe the printhead. For example, the wet porous wipe material may clean the printhead by being wiped against a nozzle surface of the printhead and absorbing residue such as fluid residue, and the like from the nozzle surface and/or nozzles thereon. Thus, the porous wipe material may be stored in a dry state and be supplied with fluid on demand from a hermetically-sealed fluid chamber. Accordingly, evaporation of the fluid may be reduced and the life and effectiveness of the cleaning module may be increased.

Figure 1:
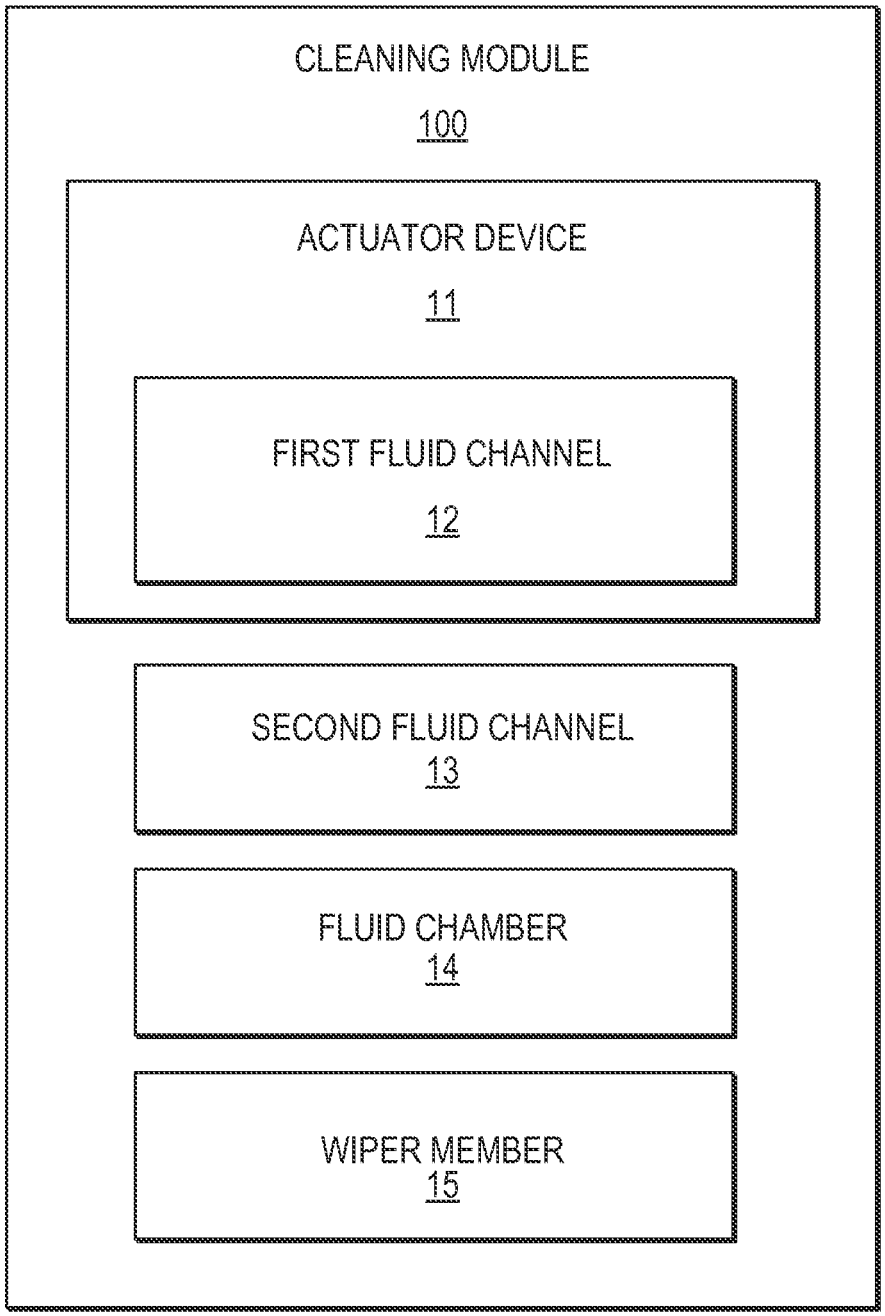
FIG. 1 is a block diagram illustrating a cleaning module according to an example.

FIG. 1 is a block diagram illustrating a cleaning module according to an example. Referring to FIG. 1, in some examples, the cleaning module 100 includes a wiper member 15, an actuator device 11, a fluid chamber 14, and a second fluid channel 13 disposed between the fluid chamber 14 and the actuator device 11. In response to an engagement with a printhead (e.g., engaged state), the actuator device 11 may enter an activation state based on a movement of at least a portion of the actuator device 11. For example, an upper portion of the actuator device 11 may be pushed when in contact with the printhead and move with respect to and/or toward a lower portion of the actuator device 11. In some examples, the actuator device 11 may include a first fluid channel 12 therein. In the activation state, for example, fluid may be directed through the first fluid channel 12 to a porous wipe material. The porous wipe material may be a porous web material to absorb and/or remove residue from the printhead during a wiping operation. In some examples, the porous wipe material may include cotton, pulp, wool, polyurethane, and the like.

Referring to FIG. 1, in some examples, the fluid chamber 14 may store fluid such as distilled water to be absorbed and used by the porous wipe material to clean the printhead during the wiping operation. Distilled water, for example, may be effective at removing fluid residue based on water-based printing fluids such as latex inks from the nozzle surface and/or nozzles of the printhead. The fluid chamber 14 may also selectively supply the fluid through the second fluid channel 13 and the first fluid channel 12 to the porous wipe material in response to the activation state of the actuator device 11. The wiper member 15 may apply pressure to the porous wipe material including the fluid therein to wipe the printhead. For example, the wet porous wipe material may clean the printhead by being wiped against a nozzle surface of the printhead to absorb and/or remove residue from the nozzle surface and nozzles thereon.

Figure 2A:
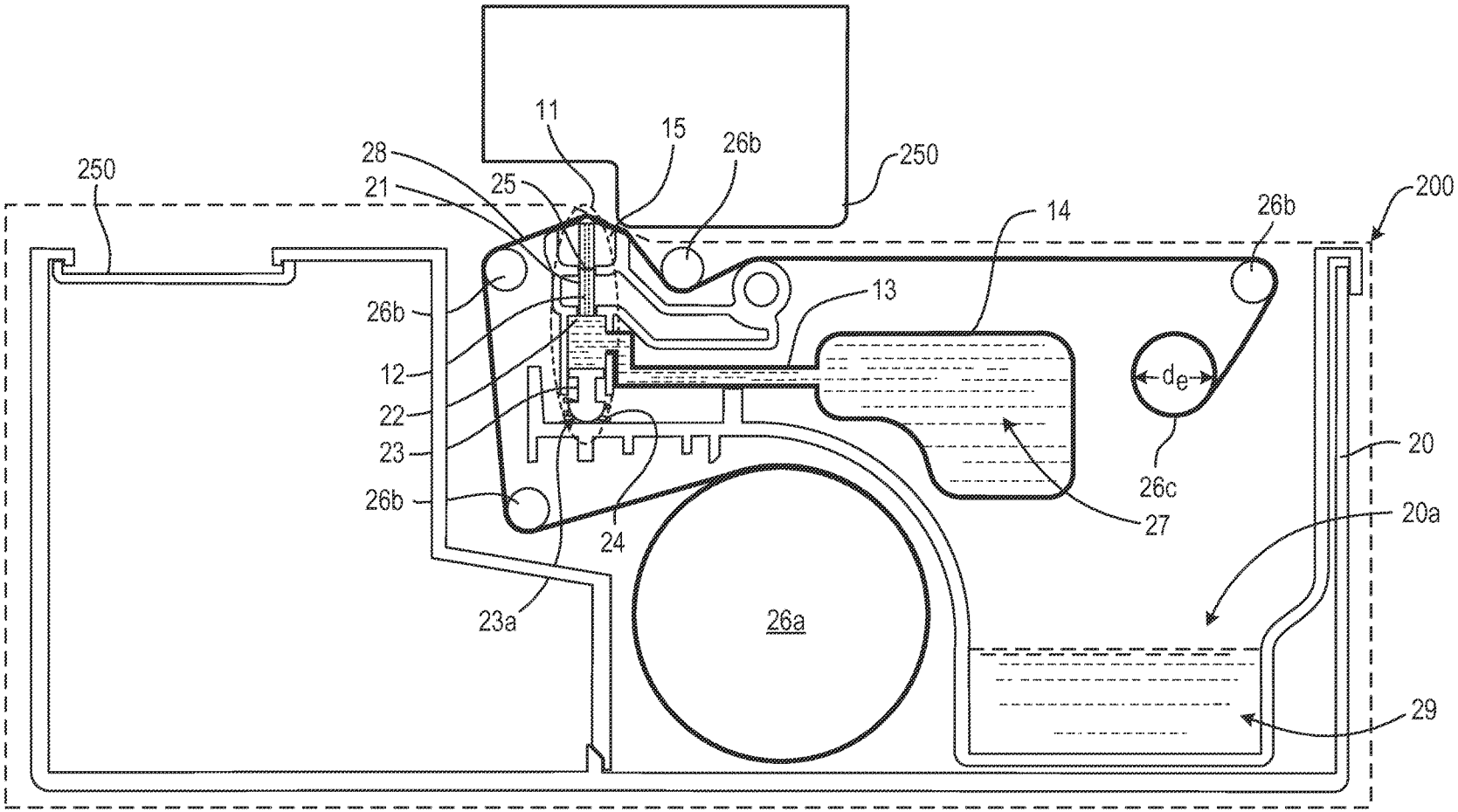
FIGS. 2A and 2B are cross-sectional views illustrating a cleaning module and a printhead in a non-engaged state and an engaged state, respectively, according to examples.
Figure 2B:
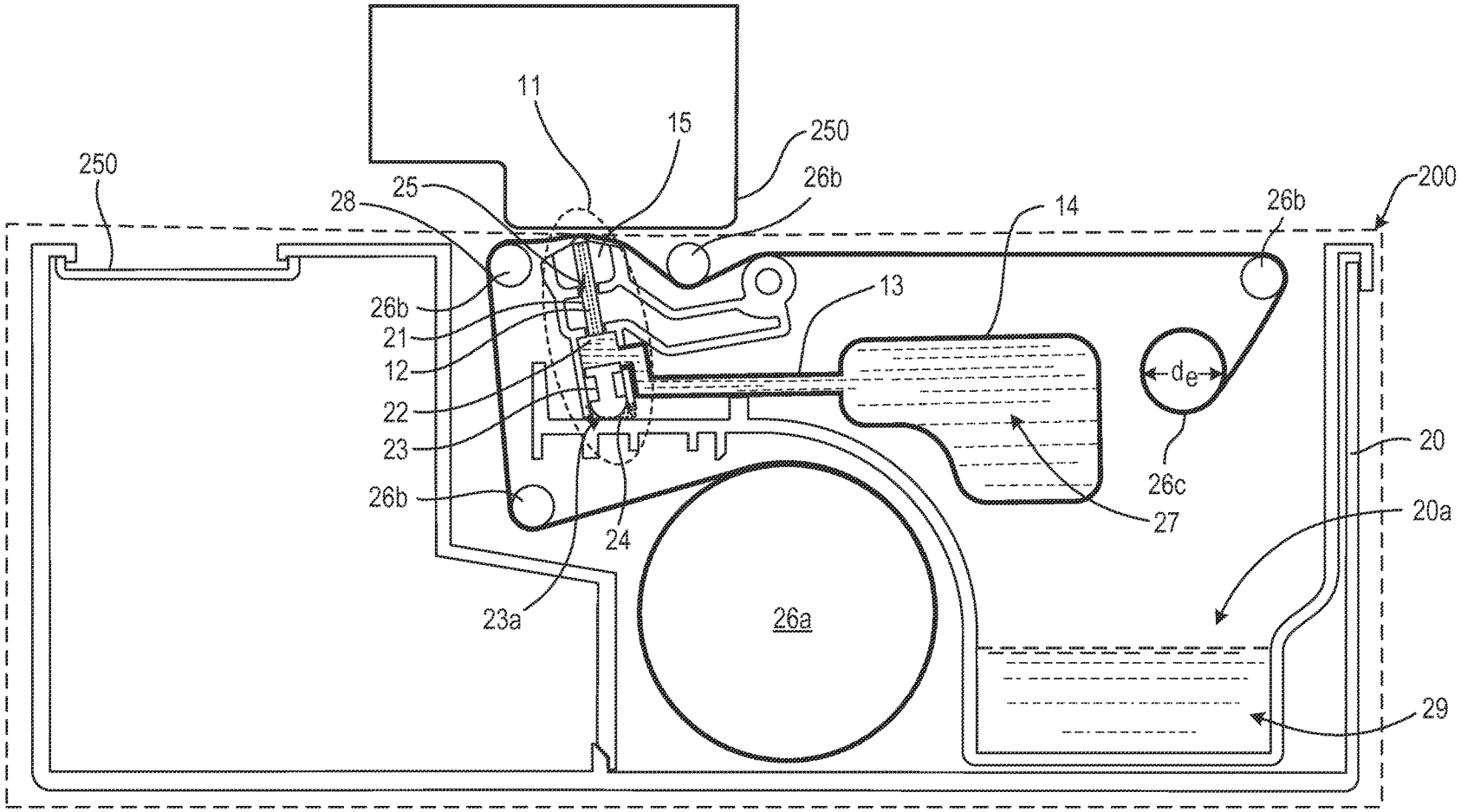

FIGS. 2A and 2B are cross-sectional views illustrating a cleaning module and a printhead in a non-engaged state and an engaged state, respectively, according to examples. A non-engaged state of the actuator device 11 may correspond to a state in which a printhead 250 and an actuator device 11 are not pressed against each other. An engaged state of the actuator device 11 may correspond to a state in which a printhead 250 and an actuator device 11 are pressed against each other to place the actuator device 11 in an activation state. The activation state of the actuator device 11 may correspond to a state in which the actuator device 11 passes fluid 27 there through to the porous wipe material 28. In some examples, the printhead 250 may include a plurality of printhead modules, a printbar, a printhead assembly, and the like. A printing fluid may include ink such as latex ink, and the like.

Referring to FIGS. 2A and 2B, in some examples, the cleaning module 200 includes the fluid chamber 14, the wiper member 15, the actuator device 11, and the second fluid channel 13 previously discussed with respect to the cleaning module 100 of FIG. 1. The cleaning module 200 may also include a main housing 20 including a main chamber 20*a* having the fluid chamber 14 disposed therein, a valve 25, a resilient member 24, and a wipe transport assembly 26 (26*a*, 26*b*, and 26*c*). In some examples, the fluid chamber 14 may be hermetically-sealed. That is, the fluid chamber 14 may be airtight to reduce evaporation of the fluid 27 therein. The main chamber 20*a* may receive and store printing fluid 29 applied by the printhead 250 during a service event. The service event may correspond to an occurrence in which printing fluid 29 is applied to the cleaning module 200 to maintain the printhead 250.

Referring to FIGS. 2A and 2B, in some examples, the cleaning module 200 may include an actuator member 21, an intermediate housing 22, and a plunger 23. The actuator member 21 and the intermediate housing 22 may correspond to an upper portion of the actuator device 11, and the plunger 23 may correspond to a lower portion of the actuator device 11. The actuator member 21 may be coupled to the intermediate housing 22 and selectively engage a printhead 250, for example, as the printhead 250 moves into contact therewith. The intermediate housing 22 may include a housing cavity to receive the fluid 27 from the fluid chamber 14 and engage the plunger 23 in response to engagement of the actuator member 21 and the printhead 250 being placed in an engaged state.

Referring to FIGS. 2A and 2B, in some examples, the engagement of the intermediate housing 22 and the plunger 23 may include the plunger 23 being further inserted into the housing cavity. The actuator member 21 and the intermediate housing 22 may be configured to move with respect to the plunger 23 to supply an amount of the fluid 27 through the first fluid channel 12 to the porous wipe material 28. In some examples, the plunger 23 may include a rounded end 23*a* to contact a surface to enable the actuator device 11 to pivot in response to the movement of at least a portion (e.g., upper portion) of the actuator device 11. The valve 25 may be disposed in the actuator member 21 to enable fluid flow in one direction and disable fluid flow in another direction. For example, the valve 25 may enable a unidirectional flow of the fluid 27 from the fluid chamber 14 to the porous wipe material 28 and prevent the fluid from flowing from the porous wipe material 28 to the fluid chamber 14.

Referring to FIGS. 2A and 2B, in some examples, the resilient member 24 may provide a force to the wiper member 15 to apply pressure on the porous wipe material 28 toward the printhead 250. That is, the wiper member 15 may be pressed into the porous wipe material 28 to place the porous wipe material 28 in contact with the printhead 250 with a predetermined amount of force thereon during a wiping operation. In some examples, the resilient member 24 may also move the actuator member 21 to its original position after the wiping operation is finished to refill the intermediate housing 22 with the fluid. In some examples, the resilient member 24 may be a spring, and the like. The wipe transport assembly may include a supply member 26*a* to supply the porous wipe material 28, a receiving member 26*c* to receive the porous wipe material 28 from the supply member 26*a*, and a plurality of guide members 26*b* to guide movement of the porous wipe material 28 from the supply member 26*a* to the receiving member 26*c*.

In some examples, the supply member 26*a*, the guide members 26*b*, and/or the receiving member 26*c* may include cylindrical members and/or rollers. The wipe transport assembly may move the porous wipe material 28 across the wiper member 15. For example, at least one of the supply member 26*a*, the guide members 26*b*, and the receiving member 26*c* may be driven to move the porous wipe material by a motor, servo, and the like. The main housing 20 may also include a cap member 250. The cap member 250 may cover a nozzle surface of the printhead 250 during a capping state to reduce printing fluid evaporation and nozzle clogging.

Figure 3A:
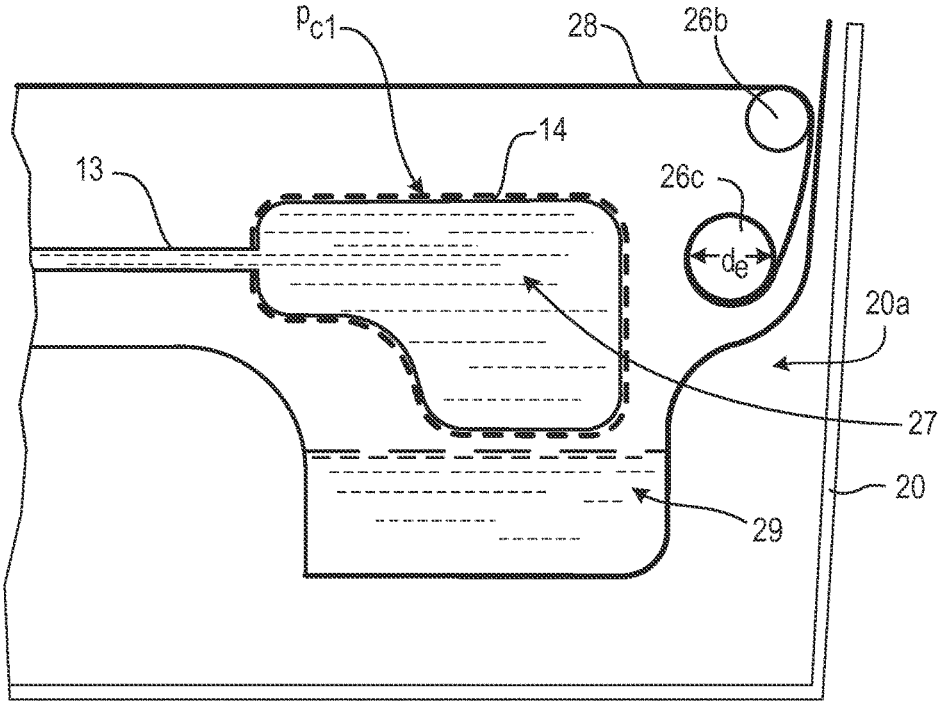
FIGS. 3A and 3B are cross-sectional views illustrating a fluid chamber in a full capacity state and in a decreased capacity state, respectively, disposed in a main chamber of a cleaning module according to examples.
Figure 3B:
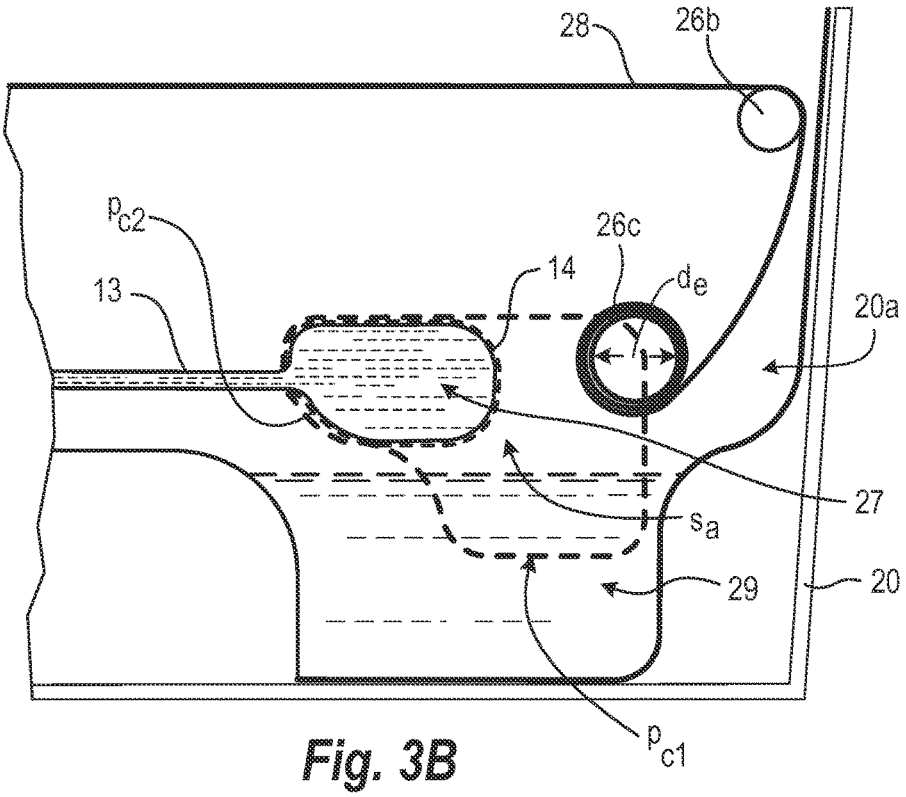

FIGS. 3A and 3B are cross-sectional views illustrating a fluid chamber in a full capacity state and in a decreased capacity state, respectively, disposed in a main chamber of a cleaning module according to examples. Referring to FIGS. 3A and 3B, in some examples, the fluid chamber 14 may include a flexible fluid chamber having a perimeter. The fluid chamber 14 may expand and increase its volume corresponding to an increased perimeter $p_{c1}$ when filled with the fluid 27 in a full capacity state (FIG. 3A). The full capacity state may correspond to a state in which a maximum amount of fluid 27 is stored in the fluid chamber 14. The fluid chamber 14 may shrink and decrease its volume corresponding to a decreased perimeter $p_{c2}$ in a decreased capacity state in response to the fluid 27 leaving the fluid chamber 14. The decreased capacity state may correspond to a state in which less than the maximum amount of fluid 27 is stored in the fluid chamber 14. Thus, the perimeter $p_c$ of the fluid chamber 14 may decrease and free up additional space $s_a$ such as a first volume in the main chamber 20*a* that it formerly occupied in response to supplying the fluid 27 from the fluid chamber 14 to the porous wipe material 28.

Referring to FIGS. 3A and 3B, in some examples, the main chamber 20*a* may receive and store printing fluid 29 therein from the printhead 250 during the service event. The received printing fluid 29 may accumulate and take up more space in the main chamber 20*a*. Over time, at least a portion of the accumulated printing fluid 29 in the main chamber 20*a* may occupy at least a portion of the additional space $s_a$ in the main chamber 20*a* formerly occupied by the fluid chamber 14. That is, the fluid chamber 14 may decrease its size as fluid is supplied to the porous wipe material 28 and free up the additional space $s_a$ for the printing fluid 29 from the printhead 250 to be stored.

Referring to FIGS. 3A and 3B, in some examples, at least a portion of the additional space $s_a$ may also be used by at least a portion of the receiving member 26*c* disposed in a main chamber 20*a* of a main housing 20 of the cleaning module. That is, the effective diameter $d_e$ of the receiving member 26*c* may increase by continually receiving the porous wipe material 28 from the supply member 26*a*. Consequently, at least a portion of the effective diameter $d_e$ of the receiving member 26*c* may occupy the additional space $s_a$ in the main chamber 20*a* formerly occupied by a portion of the fluid chamber 14. Thus, the changing of a size of the fluid chamber 14 from an increased perimeter $p_{c1}$ to a decreased perimeter $p_{c2}$ (FIG. 3B) may free up the additional space $s_a$ to be used by a portion of the increased effective diameter $d_e$ of the receiving member 26*c*.

Figure 4:
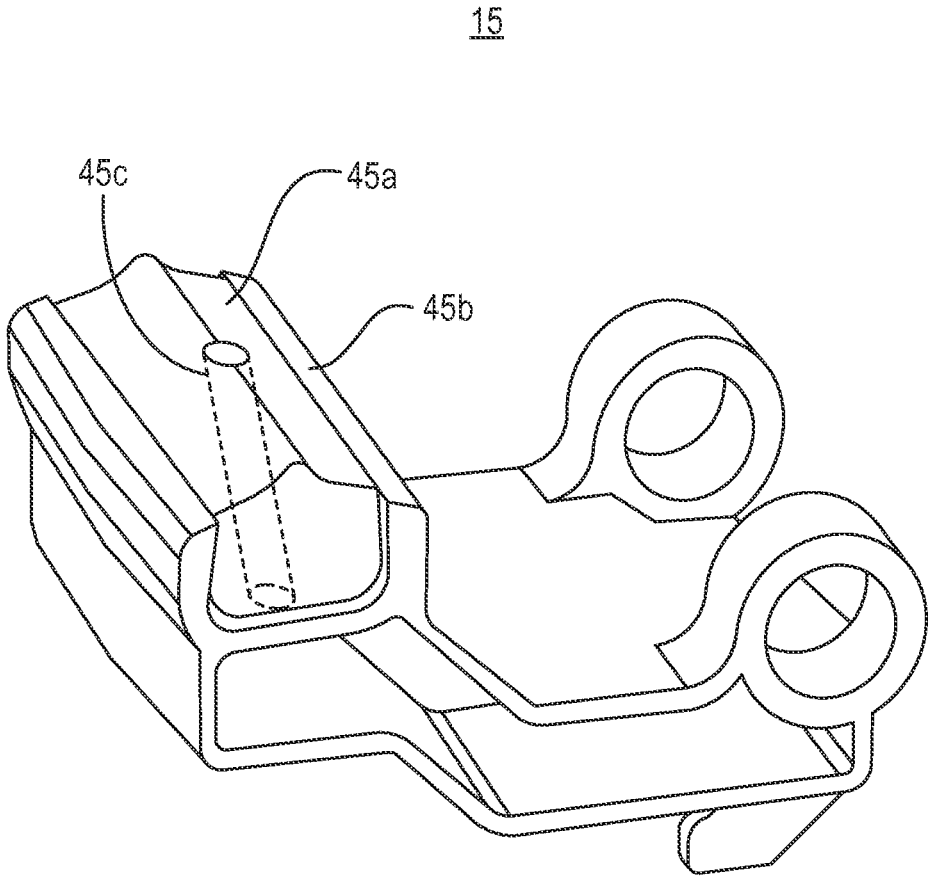
FIG. 4 is a perspective view of a wiper member of the cleaning module of FIGS. 2A and 2B according to an example.

FIG. 4 is a perspective view of a wiper member of the cleaning module of FIGS. 2A and 2B according to an example. In some examples, the wiper member 15 may include a wiper head 45*a*, a wiper frame 45*b*, and a receiving area 45*c*. The wiper head 45*a* may be coupled to the wiper frame 45*b* and selectively press the porous wipe material against the printhead during a wiping operation. In some examples, a portion of the wiper head 45*a* may conform to the nozzle surface of the printhead. The wiper frame 45*b* may hold the wiper head 45*a*. The receiving area 45*c* may be an elongated slot to receive the actuator member of the actuator device. In some examples, the wiper head 45*a* may include rubber, and the like. In some examples, the wiper frame 45*b* may include plastic, and the like.

Figure 5:
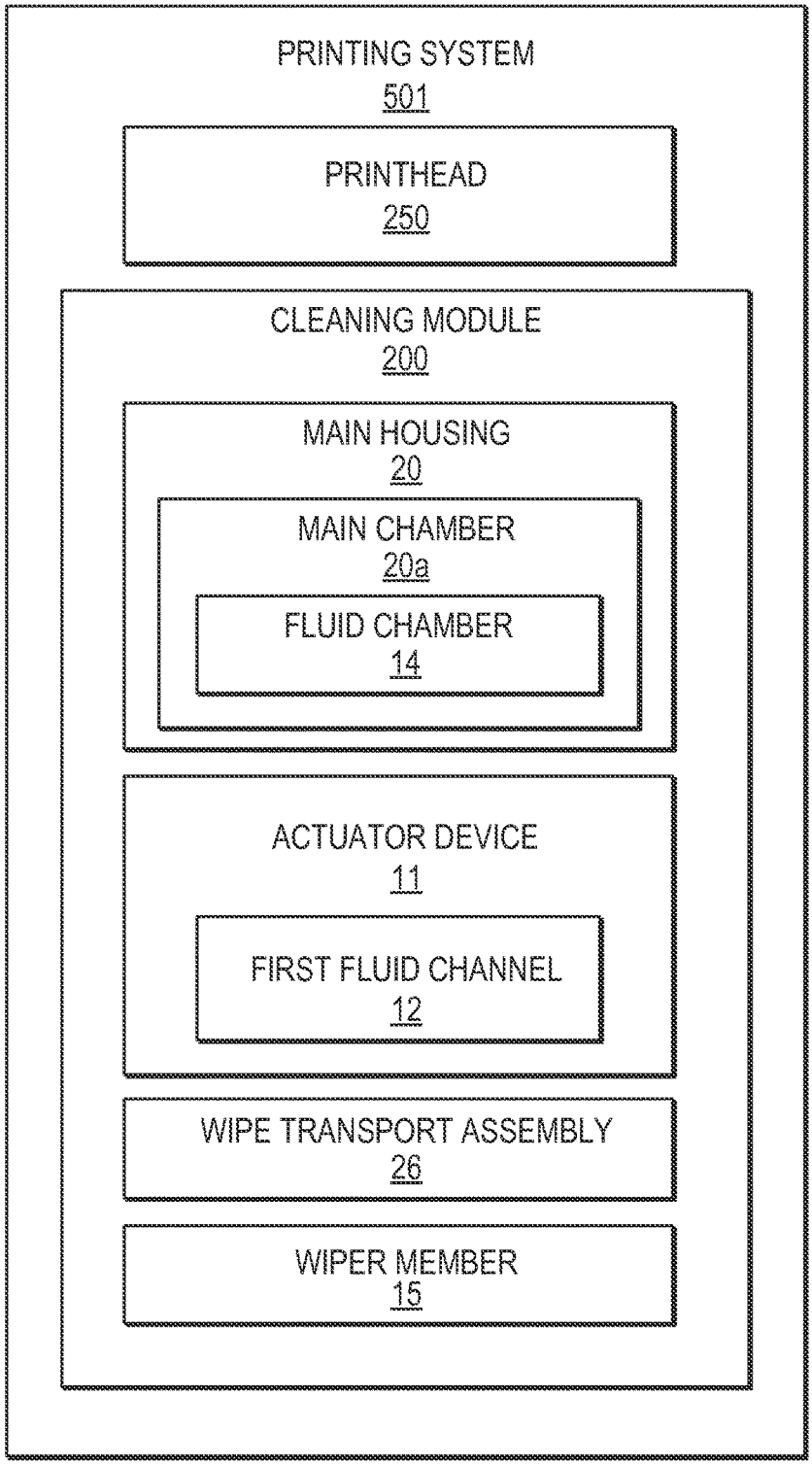
FIG. 5 is a block diagram of a printing system according to an example.

FIG. 5 is a block diagram of a printing system according to an example. Referring to FIG. 5, in some examples, a printing system 501 includes a printhead 250 and a cleaning module 200 as previously described with respect to FIGS. 2-4. The printhead 250 may apply a respective printing fluid during a print event and a service event. The print event may correspond to an occurrence in which the printhead 250 applies respective printing fluid to media to form an image. The service event may correspond to an occurrence in which respective printing fluid is applied to the cleaning module 200 to maintain the printhead 250. The cleaning module 200 may include a main housing 20, an actuator device 11, a wipe transport assembly 26, and a wiper member 15 as previously described with respect to FIGS. 2-4.

Referring to FIG. 5, in some examples, the main housing 20 may include a main chamber 20*a* to receive and store the respective printing fluid applied by the printhead 250 during the service event. The actuator device 11 may enter an activation state based on a movement of at least a portion of the actuator device 11 in response to an engagement with the printhead 250. The actuator device 11 may include a first fluid channel 12 therein. The wipe transport assembly 26 may move a porous wipe material across the wiper member 15. Thus, in some examples, a different portion of the porous wipe material may be provided to the wiper member 15 and pressed against the printhead 250 by the wiper member 15. In some examples, at least a portion of the wipe transport assembly 26 such as a receiving member 26*c* (FIGS. 3A and 3B) may be disposed in the main chamber 20*a*.

Referring to FIG. 5, in some examples, the fluid chamber 14 may be disposed in the main chamber 20*a* and hermetically-sealed to store distilled water. The fluid chamber 14 may selectively supply the distilled water through the first fluid channel 12 to the porous wipe material in response to the activation state of the actuator device 11. In some examples, a predetermined amount of distilled water may be supplied to the porous wipe material on demand. The wiper member 15 may apply pressure to the porous wipe material including the distilled water therein to wipe the printhead 250. For example, the wet porous wipe material may clean the printhead 250 by being wiped against a nozzle surface of the printhead 250 and absorbing fluid residue from the nozzle surface and/or nozzles thereon.

Figure 6:
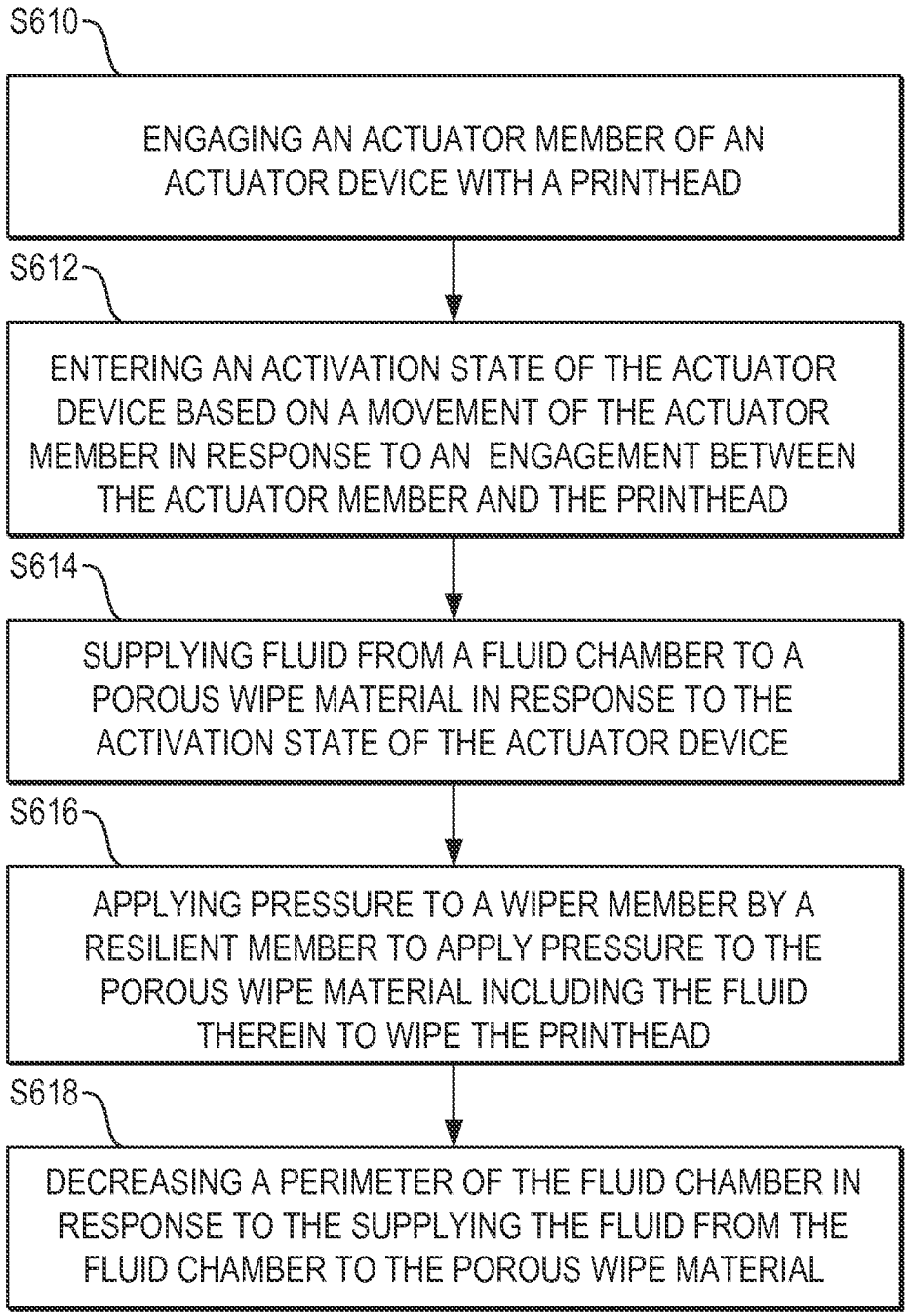
FIG. 6 is a flowchart illustrating a method of cleaning a printhead of a printing system according to an example.

FIG. 6 is a flowchart illustrating a method of cleaning a printhead of a printing system according to an example. Referring to FIG. 6, in block S610, an actuator member of an actuator device is engaged with a printhead. In block S612, an activation state of the actuator device is entered based on a movement of the actuator member in response to an engagement between the actuator member and the printhead. For example, the actuator member and an intermediate housing having a housing cavity to receive the fluid from the fluid chamber may move to engage a plunger therein to supply an amount of the fluid to the porous wipe material.

In block S614, fluid is supplied from a fluid chamber to a porous wipe material in response to the activation state of the actuator device. For example, the fluid may be supplied from the fluid chamber through a first fluid channel of the actuator member to the porous wipe material in response to the activation state of the actuator device. In some examples, the fluid chamber is hermetically-sealed and the fluid is distilled water. In block S616, pressure is applied to a wiper member by a resilient member to apply pressure to the porous wipe material including the fluid therein to wipe the printhead. In some examples, the resilient member may also move the actuator member to its original position after the wiping operation is finished to refill the intermediate housing with the fluid. In block S618, a perimeter of the fluid chamber is decreased in response to the supplying the fluid from the fluid chamber to the porous wipe material.

In some examples, the method may also include receiving printing fluid from the printhead to a main chamber of a main housing of a cleaning module during a service event such that the fluid chamber is disposed in the main chamber. Additionally, the method may also include storing at least a portion of the printing fluid in at least a portion of the additional space in the main chamber formerly occupied by a portion of the fluid chamber prior to the decreasing of the perimeter of the fluid chamber. In some examples, the method may also include supplying the porous wipe material across the wiper member by a supply member to a receiving member disposed in the main chamber of the main housing of the cleaning module. Additionally, the method may also include increasing an effective diameter of the receiving member by receiving the porous wipe material. That is, at least a portion of the effective diameter may occupy at least a portion of the additional space in the main chamber formerly occupied by a portion of the fluid chamber prior to the decreasing of the perimeter of the fluid chamber.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A cleaning module usable with a printhead of a printing system, the cleaning module comprising:

an actuator device having a first fluid channel therein, the actuator device to rotate about an axis that is positioned away from a central axis of the actuator device and to pivot on a pivot point that is located at a first end of the actuator device to enter an activation state in response to an application of force by the printhead on the actuator device;

a second fluid channel in fluid communication with the first fluid channel of the actuator device;

a fluid chamber to store fluid and coupled to the second fluid channel, wherein fluid is selectively supplied to a porous wipe material from the fluid chamber through the second fluid channel and the first fluid channel when the actuator device is in the activation state, wherein the porous wipe material is positioned externally to the actuator device and between the printhead and a second end of the actuator device; and a wiper member provided on the second end of the actuator device to apply pressure to the externally positioned porous wipe material including the fluid therein to wipe the printhead.

2. The cleaning module of claim 1, wherein the fluid chamber is hermetically-sealed and the fluid is distilled water.

3. The cleaning module of claim 1, further comprising:

a main housing including a main chamber having the fluid chamber disposed therein, the main chamber to receive and store printing fluid applied by the printhead during a service event; and wherein a perimeter of the fluid chamber is to decrease in response to the supplying of the fluid from the fluid chamber to the porous wipe material.

4. The cleaning module of claim 1, wherein the actuator device further comprises:

an actuator member;

a plunger; and an intermediate housing coupled to the actuator member, the intermediate housing having a housing cavity to receive the fluid from the fluid chamber and engage the plunger; and wherein the actuator member and the intermediate housing are to move with respect to the plunger to supply an amount of the fluid through the first fluid channel to the porous wipe material.

5. The cleaning module of claim 4, wherein the plunger comprises a rounded end to contact a surface to enable the actuator device to pivot in response to rotational movement of the actuator device, wherein the pivot point is on the rounded end.

6. The cleaning module of claim 4, further comprising:

a resilient member to provide a force to the wiper member to apply pressure on the porous wipe material toward the printhead; and wherein the wiper member includes a receiving area to receive the actuator member.

7. The cleaning module of claim 4, further comprising:

a valve disposed in the first fluid channel of the actuator member to enable a unidirectional flow of the fluid from the fluid chamber to the porous wipe material.

8. The cleaning module of claim 1, further comprising:

a wipe transport assembly to move the porous wipe material across the wiper member, the wipe transport assembly including a supply member to supply the porous wipe material, a receiving member to receive the porous wipe material from the supply member, and a plurality of guide members to guide movement of the porous wipe material from the supply member to the receiving member, wherein the porous wipe material extends from the supply member to the receiving member.

9. A printing system, comprising:

a printhead to apply a respective printing fluid during a print event and a service event; and a cleaning module, including:

a main housing including a main chamber to receive and store the respective printing fluid applied by the printhead during the service event;

an actuator device having a first fluid channel therein, the actuator device to rotate about an axis that is positioned away from a central axis of the actuator device and to pivot on a pivot point that is located at a first end of the actuator device to enter an activation state in response to application of force by the printhead on the actuator device;

a wipe transport assembly to move a porous wipe material across a wiper member, at least a portion of the wipe transport assembly disposed in the main chamber;

a fluid chamber disposed in the main chamber and hermetically-sealed to store distilled water, wherein the distilled water is selectively supplied to a porous wipe material from the fluid chamber through the first fluid channel to the porous wipe material when the actuator device is in the activation state, wherein the porous wipe material is positioned externally to the actuator device and between the printhead and a second end of the actuator device; and a wiper member to apply pressure to the porous wipe material including the distilled water therein to wipe the printhead.

10. A method of cleaning a printhead of a printing system, the method comprising:

engaging an actuator member of an actuator device with a printhead, wherein application of force onto the actuator member by the printhead causes the actuator device to rotate about an axis that is positioned away from a central axis of the actuator device and to pivot on a pivot point that is located at a first end of the actuator device to enter an activation state;

supplying fluid from a fluid chamber to a porous wipe material when the actuator device is in the activation state, wherein the porous wipe material is positioned externally to the actuator device and between the printhead and a second end of the actuator member;

applying pressure to a wiper member by a resilient member to apply pressure to the externally positioned porous wipe material including the fluid therein to wipe the printhead; and decreasing a perimeter of the fluid chamber in response to the supplying the fluid from the fluid chamber to the porous wipe material.

11. The method of claim 10, wherein the supplying fluid from a fluid chamber to a porous wipe material in response to the activation state of the actuator device further comprises:

supplying the fluid from the fluid chamber through a first fluid channel of the actuator member to the porous wipe material when the actuator device is in the activation state.

12. The method of claim 10, further comprising:

moving the actuator member and an intermediate housing having a housing cavity to receive the fluid from the fluid chamber and engage a plunger therein to supply an amount of the fluid to the porous wipe material.

13. The method of claim 10, further comprising:

receiving printing fluid from the printhead to a main chamber of a main housing of a cleaning module during a service event such that the fluid chamber is disposed in the main chamber; and storing the printing fluid in an additional space in the main chamber formerly occupied by a portion of the fluid chamber prior to the decreasing of the perimeter of the fluid chamber.

14. The method of claim 10, further comprising:

supplying the porous wipe material across the wiper member by a supply member to a receiving member disposed in a main chamber of a main housing of a cleaning module, wherein the porous wipe material extends from the supply member to the receiving member; and increasing an effective diameter of the receiving member by receiving the porous wipe material such that the effective diameter occupies an additional space in the main chamber formerly occupied by a portion of the fluid chamber prior to the decreasing of the perimeter of the fluid chamber.

15. The method of claim 10, wherein the fluid chamber is hermetically-sealed and the fluid is distilled water.

* * * * *